US005286526A

United States Patent [19]

Rantanen et al.

[11] Patent Number: 5,286,526

[45] Date of Patent: Feb. 15, 1994

[54] METHOD AND DEVICE FOR COATING OF A MOVING BASE

[75] Inventors: Rauno Rantanen, Muurame; Markku Lummila; Hannu Korhonen, both of Jyväskylä, all of Finland

[73] Assignee: Valmet Paper Machinery Inc., Finland

[21] Appl. No.: 878,862

[22] Filed: May 5, 1992

[30] Foreign Application Priority Data

May 9, 1991 [FI] Finland ..... 912260

[51] Int. Cl.[5] ..... B05C 11/04

[52] U.S. Cl. ..... 427/356; 118/126; 118/413; 118/419; 427/358

[58] Field of Search ..... 118/126, 413, 419; 427/356, 358, 430.1; 15/256.5, 256.51

[56] References Cited

U.S. PATENT DOCUMENTS

| | | | |
|---|---|---|---|
| Re. 31,695 | 10/1984 | Zink | 118/126 |
| 3,255,038 | 6/1966 | Coghill | 118/126 |
| 4,613,526 | 9/1986 | Nakamura et al. | 118/126 |
| 4,651,672 | 3/1987 | Sommer | 118/126 |
| 4,859,507 | 8/1989 | Damrau | 118/413 |
| 4,880,672 | 11/1989 | Ericksson | 118/126 |
| 4,899,687 | 2/1990 | Sommer et al. | 118/126 |
| 4,981,726 | 1/1991 | Rantanen et al. | 427/356 |
| 5,076,200 | 12/1991 | Mayer et al. | 118/413 |
| 5,077,095 | 12/1991 | Alheid | 118/126 |

*Primary Examiner*—Peter Chin
*Assistant Examiner*—Brenda Lamb
*Attorney, Agent, or Firm*—Steinberg & Raskin

[57] ABSTRACT

The invention concerns a method for coating of a moving base, such as the face of a back-up roll, paper or board web, or equivalent, with a coating agent. In the method, a blade coater is employed in which a coating blade included in the blade coater and installed in a blade holder is loaded in the area between the blade holder and the tip of the coating blade toward the moving base by means of a loading member. The coating blade forms a substantially small angle in relation to the moving base. The coating quantity applied onto the moving base is regulated by adjusting the blade angle and/or the loading of the coating blade. The coating blade is loaded towards the moving base, in the area between said loading member and the tip of the coating blade. The coating blade is additionally loaded by a second loading member so that the loading produced by the second loading member prevents separation of the tip of the coating blade from the layer of coating agent formed on the moving base so as to prevent cavitation in the area of the tip of the coating blade. The invention also concerns a device that makes use of the method.

20 Claims, 7 Drawing Sheets

PRIOR ART

METHOD AND DEVICE FOR COATING OF A MOVING BASE

FIELD OF THE INVENTION

The invention concerns a method for coating a moving base, such as the face of a back-up roll, paper or board web, or equivalent, with a coating agent by means of a blade coater, in which coater a coating blade, included in said coater and installed in a blade holder, is loaded in the area between the blade holder and the tip of the coating blade towards the moving base by means of a loading member and in which coater the coating blade forms a substantially small angle in relation to the moving base and in which coater the coating quantity applied onto the moving base is regulated by adjusting the blade angle and/or the loading of the coating blade.

The invention also concerns a device for coating a moving base, such as the face of a back-up roll, paper or board web, or equivalent, with a coating agent by means of a blade coater, which comprises a coating blade installed in a blade holder and forming a substantially small angle with the moving base, said coating blade being arranged to be loaded against the moving base in the area between the blade holder and the tip of the coating blade by means of a loading member, which is mounted in an adjustable holder, and in which coating device the coating quantity applied onto the moving base is arranged adjustable by adjusting the blade angle and/or the loading of the coating blade.

BACKGROUND OF THE INVENTION

In the case of blade coaters, substantially two running modes of different types are known. On one hand, the so-called large-angle coating is known, in which the coating blade normally forms an angle of several dozens of degrees with the moving base to be coated. On the other hand, the so-called small-angle coating is known, in which the coating blade forms an angle of just a few degrees (normally from about 0° to about 10° ) with the moving base to be coated.

The present invention is related to the latter, small-angle blade coating and in particular to a zero-angle application of the small-angle blade coating, i.e., to a case in which the blade angle at the tip of the coating blade is less than 0°, i.e., the tip of the coating blade has been bent over from 0°, so that the smallest gap between the blade and the coating base is placed before the tip of the blade.

In view of the profile of the coating quantity and in view of keeping the blade tip clean, the best results have been obtained exactly with the zero-angle blade coating, especially when the coating base is a roll face in a size press. A drawback of this prior art method has, however, been a highly limited range of operation with respect of the range of coating quantity to be controlled for if the blade has been loaded excessively in an attempt to reduce the coating quantity, the blade tip has been bent excessively apart from the coating base, which has resulted in streaks in the coating. Such a coating device that makes use of the prior art coating method is illustrated schematically in FIG. 6. In this figure, the coating device is denoted generally with the reference numeral 30. The coating device 30 as shown in FIG. 6 is a so-called short-dwell coating device, which comprises a pressurized coating-agent chamber 31, which is defined by the coating blade 32, by a front seal 33, and by lateral seals (not shown). The coating blade 32 is installed in a blade holder 34, and the coating blade 32 is loaded against the moving base B, such as the face of a roll in the size press, by means of a loading hose 35 in the area between the blade holder 34 and the tip 39 of the coating blade. The loading hose 35 is installed in a loading-hose holder 37, with which an adjusting device 36 is also connected, by whose means the loading-hose holder 37 can be adjusted in the coater. In FIG. 6, the coating distance, i.e., the coating zone, is denoted with the reference S1 and the zone is defined in the area between the coating blade 32 and the front seal 33, in which the coating agent is in direct contact with the moving base B to be coated. The direction of movement of the moving base B is denoted with an arrow and with the reference D.

In the prior-art solution shown in FIG. 6, the loading of the coating blade 32 has been increased to such a high level that the tip 39 of the coating blade has been bent apart from the base B to be coated, which has produced cavitation at the tip 39 of the coating blade, as a result of which streaks have been formed in the layer of coating agent formed on the face of the moving base B.

SUMMARY AND OBJECT OF THE INVENTION

An object of the present invention is to provide a method and a device for application of a method by whose means the drawback of cavitation occurring with zero-angle blade coating at the tip of the coating blade is avoided.

In view of achieving this object and others, in the method in accordance with the invention, the coating blade is loaded towards the moving base, in the area between said loading member and the tip of the coating blade, additionally also by means of a second loading member so that, by means of the loading produced by said second loading member, separation of the tip of the coating blade from the layer of coating agent formed on the moving base is prevented so as to prevent cavitation in the area of the tip of the coating blade.

On the other hand, in the device for application of the method in accordance with the invention, between the loading member of the coating blade and the tip of the coating blade, a second loading member is fitted to load the coating blade towards the moving base to prevent separation of the tip of the coating blade from the layer of coating agent formed on the moving base and to prevent cavitation in the area of the tip of the coating blade.

A most important advantage of the invention is that, by means of the method and the device of the invention, rising of the tip of the coating blade apart from the base to be coated is prevented, whereby, by means of the invention, a considerably larger range of coating agent quantity can be controlled than by means of the prior-art methods and devices. Thus, the controllability and the uniformity of the coating quantity are essentially better than in prior art.

Further advantages and characteristic features of the invention are apparent from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
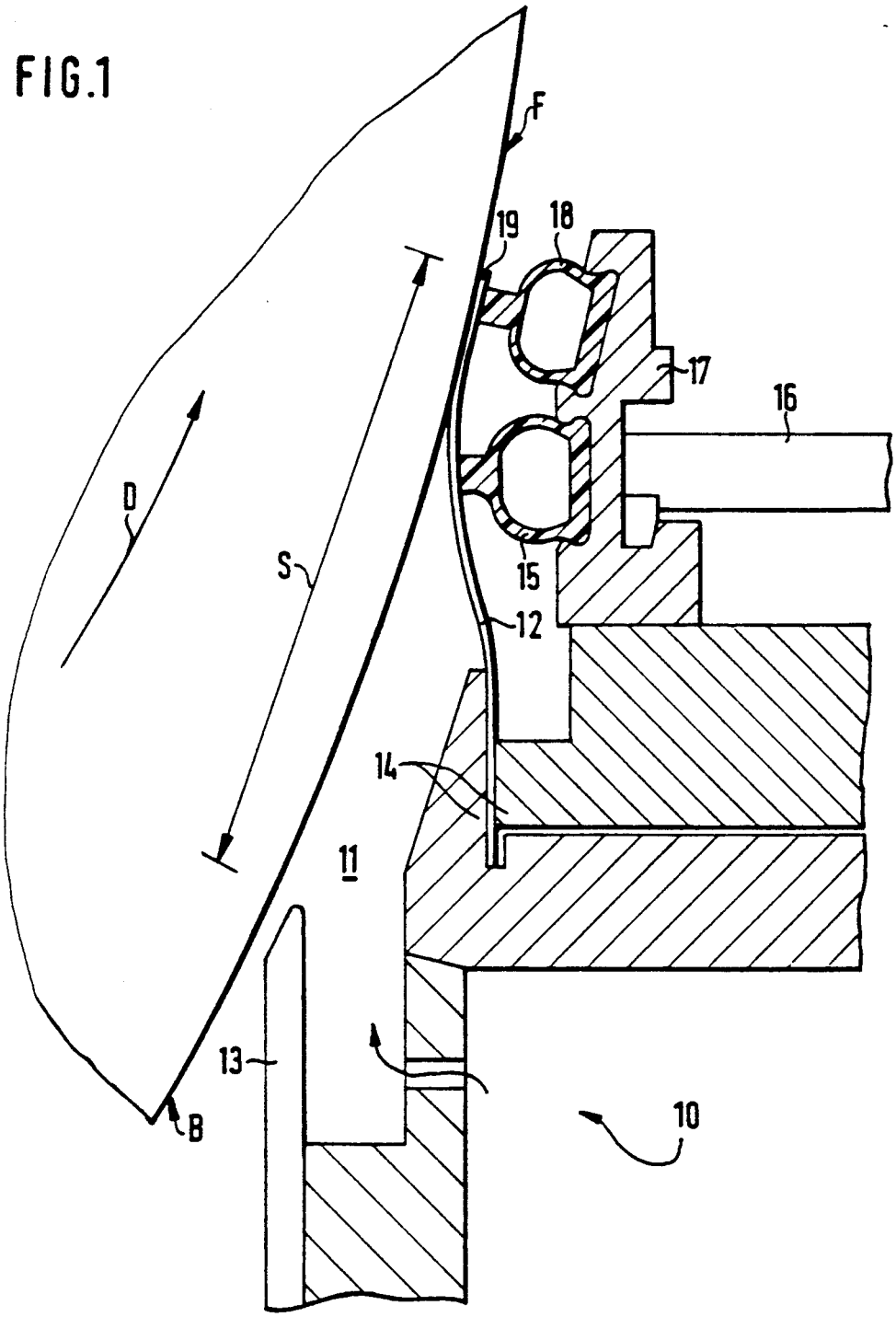
FIG. 1 is a schematic sectional side view of an embodiment of a device that makes use of the method of the invention.

FIG. 1 shows a first embodiment of the device that makes use of the method of the invention. In this figure, the coating device is denoted generally with the reference numeral 10. In the embodiment of FIG. 1, the coating device 10 comprises a coating-agent chamber 11, which is defined by the coating blade 12, the front seal 13, and by the lateral seals (not shown).

The coating blade 12 rests at a small angle against the moving base B to be coated, which is, for example, a paper or board web or a roll face. In FIG. 1, the direction of movement of the base B to be coated is denoted with an arrow and with the reference D.

Between the moving base B and the front seal 13, there is a gap of specified magnitude, which gap can be adjusted if necessary and by whose means it is possible to regulate the overflow of the coating agent from the coating-agent chamber 11. Thus, the coating distance S is defined by the coating blade 12 and front seal 13, between which the coating agent is in direct contact with the base B to be coated. The coating agent is introduced into the coating-agent chamber 11 in the conventional way under pressure.

The coating blade 12 is attached to the frame of the coating device 10 by means of a blade holder 14, and, moreover, in the conventional way, the frame of the coating device 10 is provided with a loading hose 15 or with a corresponding loading member, which is installed in a holder 17 supported on the frame of the coating device. By means of said loading hose 15, the coating blade 12 is loaded towards the moving base B to be coated in the area between the blade holder 14 and the tip 19 of the coating blade.

Further, the coating device 10 is provided with an adjusting device 16, by whose means the holder 17 of the loading hose 15 can be shifted in the coating device 10. In these respects, the construction of the coating device 10 is quite conventional.

In the solution in accordance with the invention, the coating device 10 is additionally provided with a second loading member, for example a loading hose 18 shown in FIG. 1, by whose means the tip area of the coating blade 12 is loaded towards the base B to be coated.

In the embodiment of FIG. 1, said second loading member 18 is attached to the same holder 17 as the loading hose 15, but, if necessary, the second loading member 18 can be installed on a separate holder of its own (not shown). In the embodiment of FIG. 1, the second loading member 18 can be shifted in the horizontal direction, i.e. substantially towards, and away from, the base B to be coated, together with the first loading hose 15 or a corresponding loading member, by shifting the holder 17 by means of the adjusting device 16.

In some cases it would be advantageous if it were possible to shift the loading members 15 and 18 also in the vertical direction, i.e. substantially in the tangential direction of the base B to be coated, but in the embodiment of FIG. 1 this is not possible. In such a case in which vertical shifting is possible, it would be possible to adjust the locations of the loading members 15 and 18 on the rear face of the coating blade 12.

Figure 7:
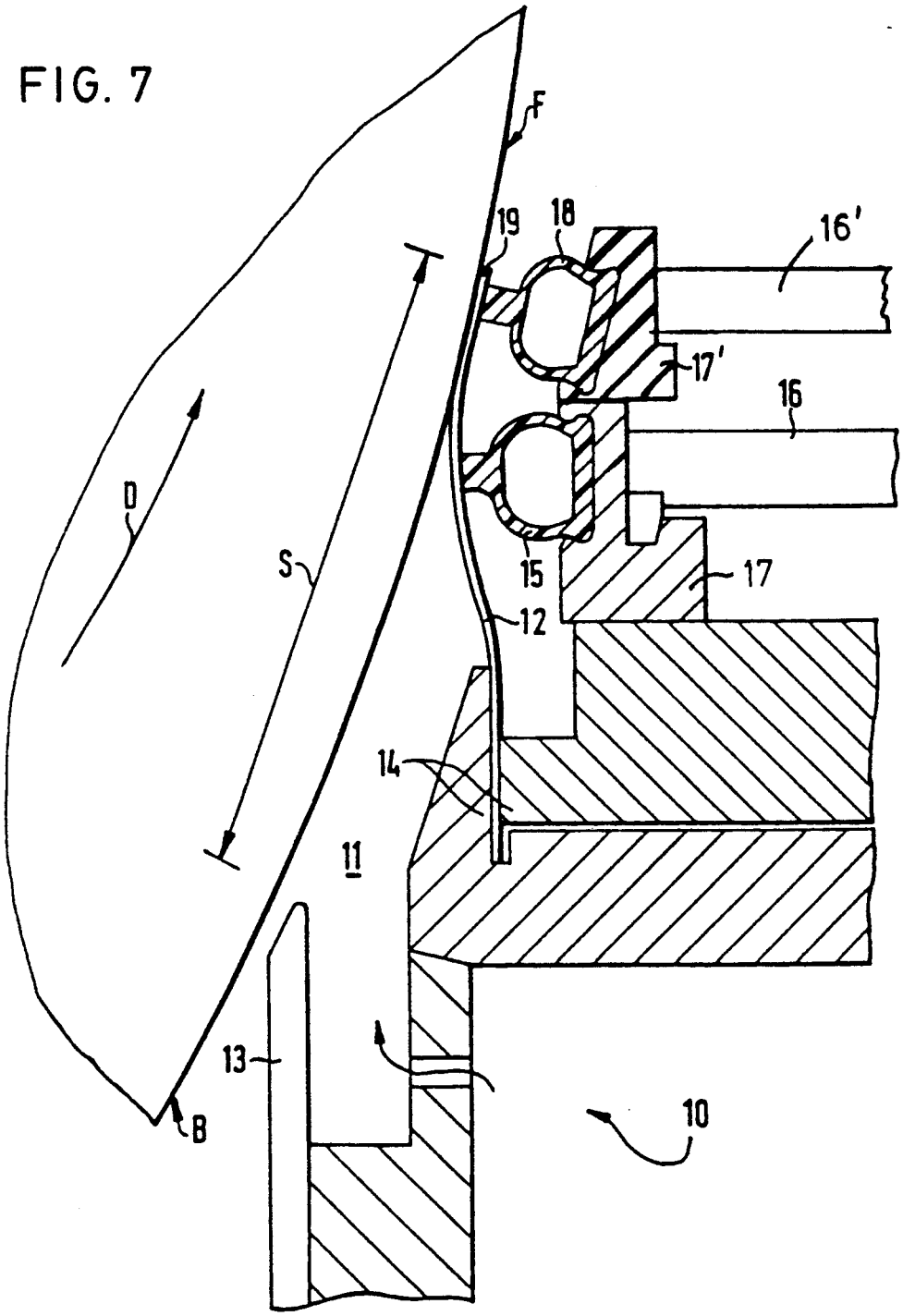
FIG. 7 is a schematic sectional side view of an embodiment of the device in accordance with the invention as shown in FIG. 1 and having a separate holder for each of the loading members.

Differing from the illustration in FIG. 1, it is also possible that the second loading member 18, such as a loading hose or equivalent, is installed in a separate holder of its own as shown in FIG. 7 wherein the second loading member 18 is mounted in holder 17'. In such a case, the second loading member 18 could be adjusted by an adjusting device 16' individually and independently from the first loading member 15 both vertically and horizontally. In other respects, the elements in FIG. 7 correspond to the elements having the same reference numerals in the embodiment of FIG. 1.

By means of the second loading member 18, it is possible to prevent rising of the tip 19 of the coating blade 12 from the face of the base B to be coated, which is also a primary objective of the invention. By means of the first loading member 15, the quantity of the coating agent is regulated in the conventional way. Thus, by means of the invention, separation of the tip 19 of the coating blade from the coating-agent layer F formed can be prevented, whereby no cavitation occurs in the area of the tip 19 of the coating blade.

In the embodiment as shown in FIG. 1, the invention has been applied in connection with a short-dwell blade coater, in which, by means of the invention, besides the advantages listed above, the additional advantage is obtained that, when the quantity of coating agent is adjusted, the angle of the coating blade 12 and the gap of the front seal 13 do not necessarily have to be adjusted separately. In such an embodiment, replacement of the lateral seals is also avoided.

Besides coating devices of the short-dwell type, the invention can also be applied to blade coaters of other types, for example to coating devices provided with an applicator roll.

Figure 2:
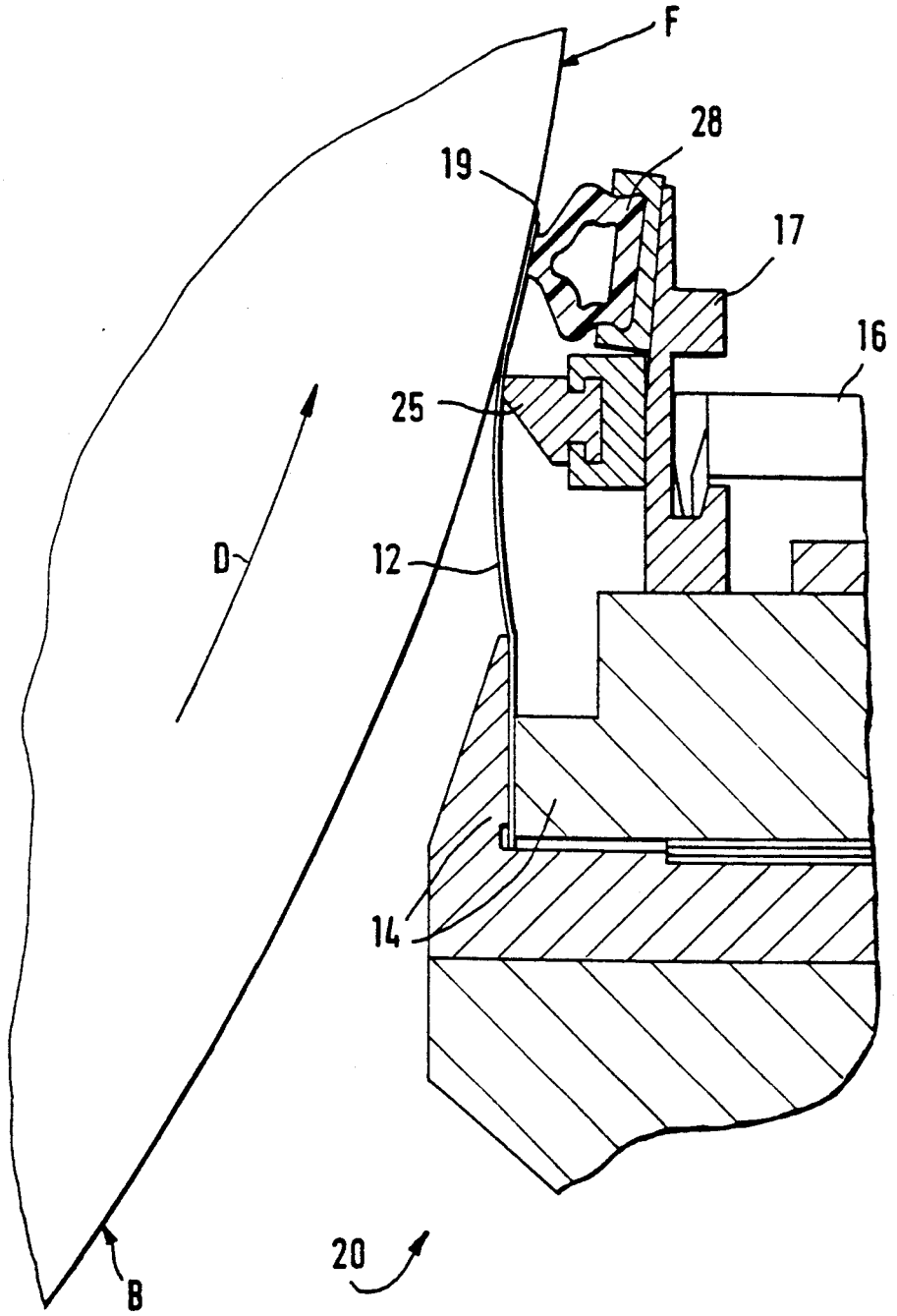
FIG. 2 is also a schematic sectional view of a second embodiment of a device that makes use of the method of the invention.

Attempts have been made to illustrate one such embodiment in FIG. 2. In the illustration in FIG. 2, the applicator roll and the related equipment have been omitted, and so, in FIG. 2, of the coating device, only the suspension of the coating blade and the constructions related to the regulation means are shown.

In FIG. 2, the coating device is denoted generally with the reference numeral 20. The coating blade 12 included in the coating device 20 rests at a small angle against the moving base B, which is, e.g., a roll face or equivalent. The coating blade 12 is installed conventionally in a blade holder 14, and further a holder 17 is mounted on the frame constructions of the coating device, on which holder 17 a rigid loading rib 25 is supported, by whose means the coating blade 12 is loaded towards the moving base B by means of an adjusting device 16 by shifting the holder 17. In the embodiment shown in FIG. 2, a second loading member 28 is installed in the same holder 17, which loading member 28 is installed in the same holder 17, which loading member 28 is, in the embodiment of FIG. 2, a loading hose or equivalent. By means of said second loading member 28, the tip area of the coating blade 12 is loaded so that rising of the tip 19 of the coating blade 12 apart from the face of the moving base B and from the coating-agent layer F is prevented. Thus, also by means of the embodiment of FIG. 2, the problems of cavitation related to conventional solutions can be avoided.

The embodiment in FIG. 2 can also be varied in many ways, for example so that the second loading member 28 is installed in a holder of its own (not shown), in which case it would be possible to adjust said second loading member 28 independently from the loading rib 25. Further, the embodiment of FIG. 2 can also be varied so that, instead of a rigid loading rib 25, for example, a loading hose similar to that shown in FIG. 1 is used. In a corresponding way, in the embodiment of FIG. 1, instead of the first loading member 15, it is possible to use a loading rib 25 as shown in FIG. 2. Similarly to FIG. 1, in FIG. 2, the direction of movement of the moving base B is likewise denoted with an arrow and with the reference D.

Figure 3:
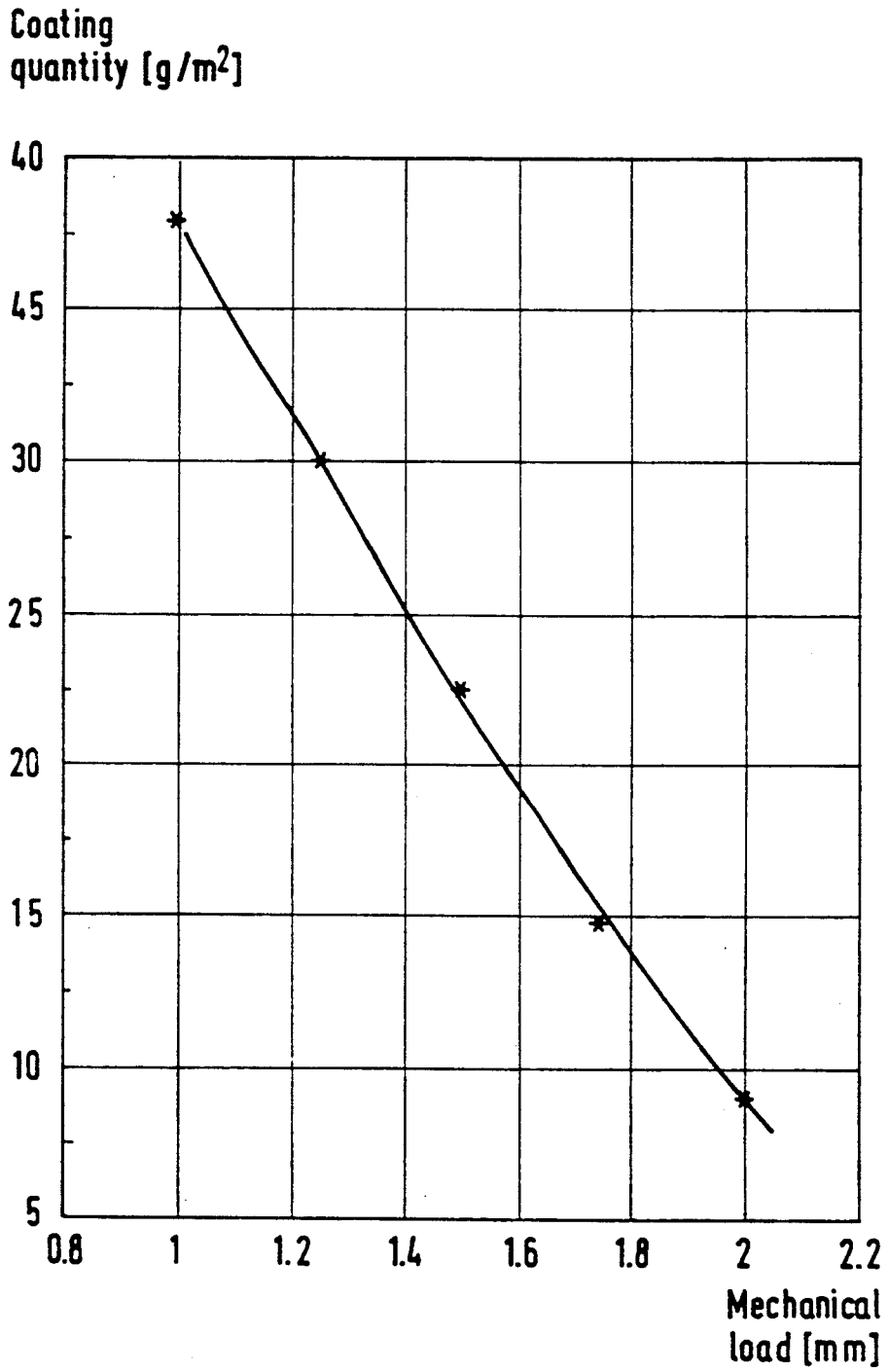
FIGS. 3 and 4 are graphic presentations which illustrate the coating agent quantity achieved by means of the method of the invention as a function of the loading of the coating blade.
Figure 4:
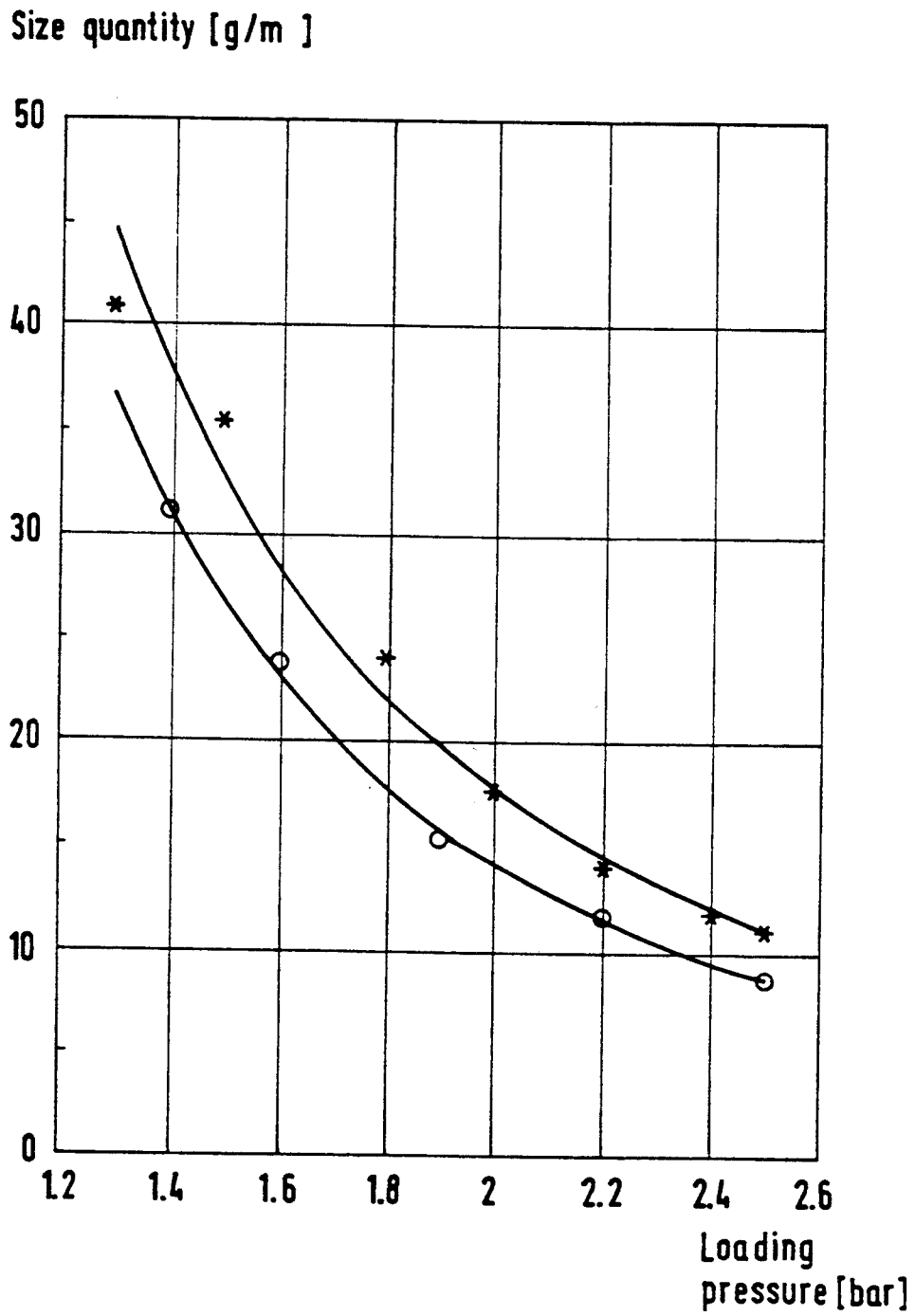

Next, the effect produced by means of the invention on the coating result will be presented by means of the FIGS. 3 and 4. FIGS. 3 and 4 are graphic presentations of the coating quantities achieved by means of a test coating device as a function of the loading of the coating blade. The results in FIG. 3 have been obtained by means of a coating device provided with the coating-blade loading method in accordance with the invention, in which device the coating blade 12 has been loaded by means of a rigid loading rib 25 as shown in FIG. 2 while adjusting the position of said rib 25 in relation to the coating blade 12. On the other hand, the results illustrated in FIG. 4 have been obtained with the same coating device while, instead of the rigid loading rib 25, employing a loading hose 15, the loading of the coating blade 12 being adjusted by varying the pressure in said hose 15. In the cases of both FIG. 3 and FIG. 4, the area of the tip of the coating blade 12 has been loaded by means of the loading hose 18 or 28.

The results of FIG. 3 were obtained with a solution in which the coating agent used was a pigment coating agent whose dry solids content was 40%. The coating velocity was 600 m/min.

Figure 6:
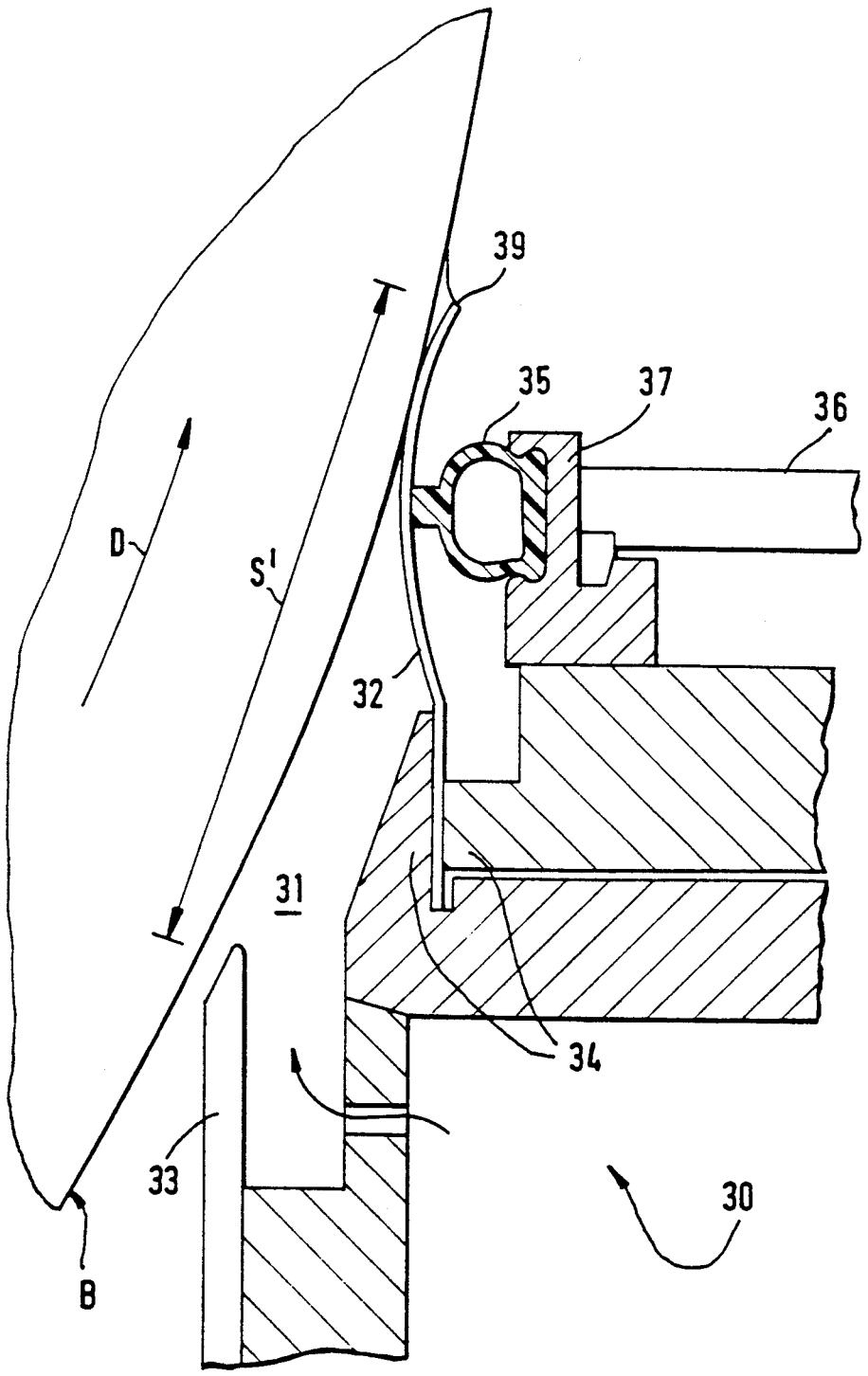
FIG. 6 is a prior art short-dwell coating device.

With a conventional prior art solution, e.g. that shown in FIG. 6, it is normally possible to operate within a range which is of an order of from about 20 to about 30 g/m$^2$. With the load with which a coating quantity of an order of 20 g/m$^2$ is obtained, the tip of the coating blade is, in prior art solutions, separated excessively from the base B to be coated, which produces an uneven coating-agent profile and contamination of the tip of the blade.

By means of a coating device provided with a coating-blade loading method in accordance with the invention, the range of coating quantity can be extended so that considerably thinner coating quantities are obtained while the coating result remains good.

For example, in the case of the curve shown in FIG. 3, with a conventional coating device, the minimum coating quantity that can be achieved is of an order of 11 g/m$^2$ of dry coating. On the other hand, by means of a device in accordance with the invention, a minimum quantity is achieved which is less than about 3 g/m$^2$ of dry coating. This is a significant improvement in comparison to the prior art.

FIG. 4 illustrates the coating quantity achieved by means of the coating-blade loading method in accordance with the invention as a function of the loading pressure at two different coating velocities. The curve denoted with an asterisk represents a coating velocity of 1000 m/min, and the curve denoted with a circle a coating velocity of 800 m/min. The coating agent used was surface size whose dry solids content was 10% and viscosity 20 mPas.

In the case of FIG. 4, the goal aimed at with respect to the range of coating quantity was from about 10 to about 30 g/m$^2$ of wet coating. This was not reached at all with a conventional prior art device, with which the minimum was 31 g/m$^2$. Instead, with the device in accordance with the invention, the above range of coating quantity established in practice was obtained readily with both of the different coating velocities by just changing the loading pressure. In this case as well, the improvement over the prior art was remarkable.

Figure 5:
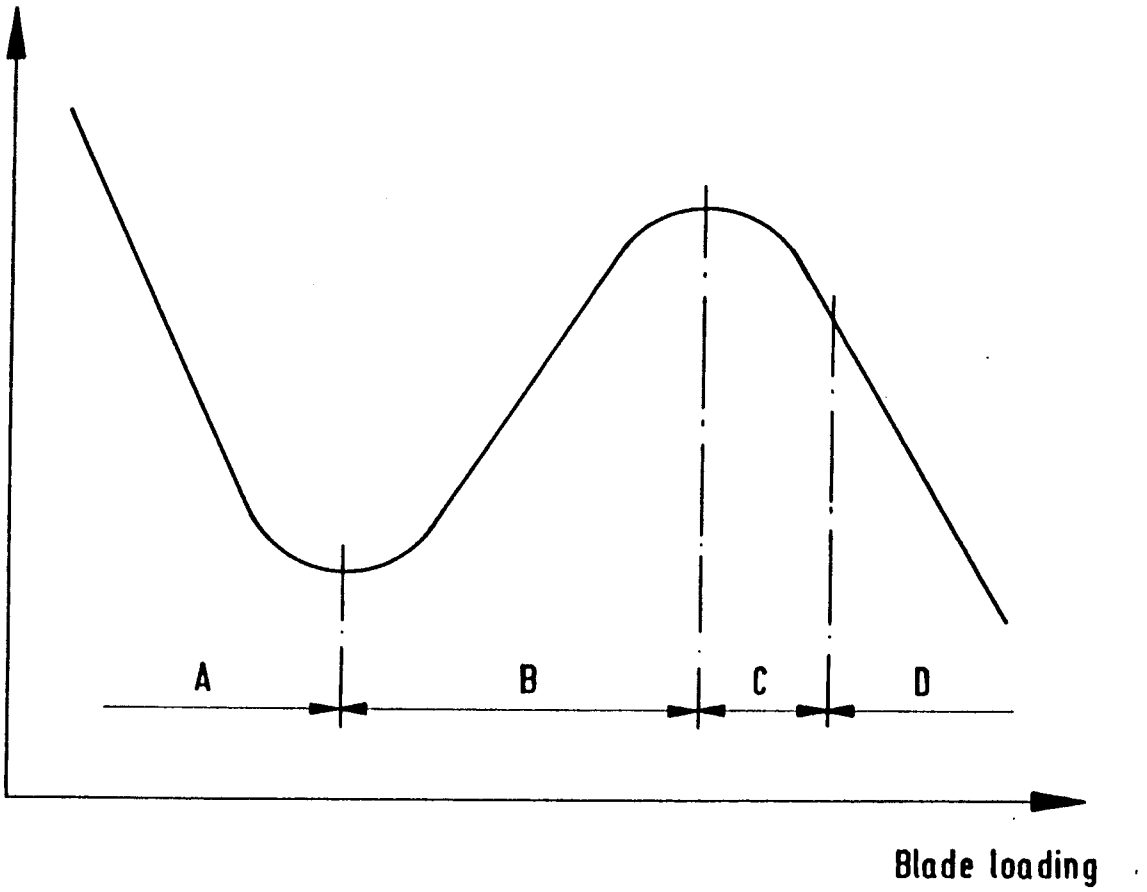
FIG. 5 is a graphic presentation which shows a comparison of the quantities of coating agent obtained with different modes of blade coating as a function of the loading of the coating blade.

Finally, in the graphic presentation in FIG. 5, coating quantities obtained with different blade-coating modes have been compared as a function of the loading of the blade. In FIG. 5, the area A represents a large-angle blade coating, the area B a conventional small-angle blade coating, and the area C a conventional zero-angle blade coating. By means of the coating method of the invention, a regulation of the coating quantity is obtained that includes the areas C and D together. Thus, FIG. 5 is perhaps the best illustration of the advantages obtained by means of the invention as compared with the prior art.

Above, the invention has been described by way of example with reference to the exemplifying embodiments illustrated in the figures. The invention is, however, not confined to the exemplifying embodiments illustrated in the figures alone, and the examples provided above are not meant to be exclusive. Many other variations of the present invention would be obvious to those skilled in the art, and are contemplated to be within the scope of the appended claims.

What is claimed is:

1. A method for coating a moving base, the face of a back-up roll, paper or board web, with a coating agent by means of a blade coater, comprising installing a coating blade in a blade holder such that said coating blade forms a substantially small angle in relation to a moving base to be coated, loading said coating blade in an area between said blade holder and a tip of the coating blade located in proximity to the moving base by means of a first loading member, loading said coating blade towards the moving base in an additional location between said first loading member and said tip of said coating blade by means of a second loading member so that the smallest gap between said coating blade and the moving base is located before the tip of said coating blade, arranging said second loading member such that said second loading member prevents separation of said tip of said coating blade from a layer of coating agent formed on the moving base, thereby preventing cavitation in the area of said tip of said coating blade, applying a coating agent onto the moving base, and regulating the quantity of the coating agent applied onto the moving base via said first loading member by adjusting the blade angle and/or the loading of said coating blade.

2. The method of claim 1, further comprising loading said coating blade by means of said second loading member substantially in the area of said tip of the coating blade.

3. The method of claim 2, further comprising independently regulating the load produced by said second loading member on said coating blade from the load produced by said first loading member.

4. The method of claim 2, further comprising regulating the loads produced by both said first and said second loading members together.

5. The method of claim 2, further comprising loading said second loading member such that said coating blade is loaded in a direction that differs from the loading direction of said first loading member.

6. A device for coating a moving base, the face of a back-up roll, paper or board web, with a coating agent by means of a blade coater, comprising a moving base, a coating blade installed in a blade holder and forming a substantially small angle with said moving base, a first loading member structured and arranged to load said coating blade against said moving base in an area between said blade holder and a tip of said coating blade, said first loading member being mounted in an adjustable holder and regulating the thickness of a layer of coating agent formed on said moving base via an adjustment in the blade angle and/or an adjustment in the loading of said coating blade, and a second loading member located between said first loading member of said coating blade and said tip of said coating blade, said second loading member being structured and arranged to load said coating blade toward the moving base to prevent separation of said tip of said coating blade from the layer of coating agent formed on said moving base, thereby preventing cavitation in the area of said tip of said coating blade, said second loading member being loaded such that the smallest gap between said coating blade and said moving base is located before said tip of said coating blade.

7. The device of claim 6, wherein said second loading member is arranged to load said coating blade substantially in the area of said tip of said coating blade.

8. The device of claim 7, wherein said second loading member is adjustable.

9. The device of claim 6, wherein said second loading member is arranged to load the coating blade in a direction that differs from the loading direction of said first loading member.

10. The device of claim 6, wherein said second loading member is a loading hose.

11. The device of claim 6, wherein said second loading member is mounted in the same adjustable holder as said first loading member.

12. The of claim 6, wherein said second loading member is mounted in a separate holder from said first loading member.

13. The device of claim 8, wherein said first loading member is a loading hose.

14. The device of claim 8, wherein said first loading member is a rigid loading rib.

15. The device of claim 6, wherein the blade angle at said tip of said coating blade is less than 0°.

16. A device for coating a moving base, the face of a back-up roll, paper or board web, with a coating agent by means of a blade coater, comprising a moving base, a coating blade installed in a blade holder and forming a substantially small angle with said moving base, a first loading member structured and arranged to load said coating blade against said moving base in an area between said blade holder and a tip of said coating blade, said first loading member being mounted in an adjustable holder and regulating the thickness of a layer of coating agent formed on said moving base via an adjustment in the blade angle and/or an adjustment in the loading of said coating blade, said first loading member comprising a rigid loading rib, and a second loading member located between said first loading member of said coating blade and said tip of said coating blade, said second loading member being structured and arranged to load said coating blade toward the moving base to prevent separation of said tip of said coating blade from the layer of coating agent formed on said moving base, thereby preventing cavitation in the area of said tip of said coating blade, said second loading member being loaded such that the smallest gap between said coating blade and said moving base is located before said tip of said coating blade, said second loading member being arranged after the smallest gap and comprising an adjustable loading hose.

17. The device of claim 16, wherein said second loading member is arranged to load said coating blade substantially in the area of said tip of said coating blade.

18. The device of claim 16, wherein said second loading member is arranged to load the coating blade in a direction that differs from the loading direction of said first loading member.

19. The device of claim 16, wherein said second loading member is mounted in the same adjustable holder as said first loading member.

20. The device of claim 16, wherein said second loading member is mounted in a separate holder from said first loading member.

* * * * *